US008437663B2

(12) United States Patent
Hoshio

(10) Patent No.: US 8,437,663 B2
(45) Date of Patent: May 7, 2013

(54) CHARGING MEMBER, PROCESS CARTRIDGE AND IMAGE FORMING APPARATUS

(75) Inventor: Takuro Hoshio, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 378 days.

(21) Appl. No.: 12/534,981

(22) Filed: Aug. 4, 2009

(65) Prior Publication Data

US 2010/0247149 A1 Sep. 30, 2010

(30) Foreign Application Priority Data

Mar. 27, 2009 (JP) ..... 2009-080549

(51) Int. Cl.
*G03G 15/02* (2006.01)

(52) U.S. Cl.
USPC ..... 399/176

(58) Field of Classification Search ..... 399/174, 399/176

See application file for complete search history.

(56) References Cited

U.S. PATENT DOCUMENTS

| | | | | |
|---|---|---|---|---|
| 6,810,225 | B2 * | 10/2004 | Kitano et al. | 399/176 |
| 6,841,327 | B2 * | 1/2005 | Otake et al. | 430/123.3 |
| 7,171,141 | B2 * | 1/2007 | Abe et al. | 399/176 |
| 8,241,527 | B2 * | 8/2012 | Minagoshi | 252/511 |
| 2004/0265006 | A1 * | 12/2004 | Taniguchi et al. | 399/174 |

FOREIGN PATENT DOCUMENTS

| | | | |
|---|---|---|---|
| JP | 58014858 | * | 1/1983 |
| JP | 58014858 A | * | 1/1983 |
| JP | A-6-264918 | | 9/1994 |
| JP | A-07-020679 | | 1/1995 |
| JP | A-7-64378 | | 3/1995 |
| JP | B2-2649162 | | 9/1997 |
| JP | B2-3024248 | | 3/2000 |
| JP | A-2001-099137 | | 4/2001 |
| JP | A-2006-163059 | | 6/2006 |
| JP | A-2007-65469 | | 3/2007 |
| JP | A-2007-93937 | | 4/2007 |
| JP | A-2007-101864 | | 4/2007 |
| JP | A-2007-225914 | | 9/2007 |
| JP | A-2008-276024 | | 11/2008 |

OTHER PUBLICATIONS

Office Action issued in Japanese Application No. 2009-080549 dated Mar. 1, 2011 (with translation).

* cited by examiner

*Primary Examiner* — Walter L Lindsay, Jr.
*Assistant Examiner* — Frederick Wenderoth
(74) *Attorney, Agent, or Firm* — Oliff & Berridge, PLC

(57) ABSTRACT

The present invention provides a charging member that includes at least: a base material; and a conductive outermost layer that is disposed on the base material, comes into contact with a body to be charged, has a ten-point average surface roughness Rz of about 2 μm to about 20 μm, and contains (A) a resin and (B) specific conductive particles for forming the surface roughness, the charging member coming into contact with the body to be charged, in a state where a voltage is applied, to charge the body to be charged.

12 Claims, 4 Drawing Sheets

CHARGING MEMBER, PROCESS CARTRIDGE AND IMAGE FORMING APPARATUS

CROSS-REFERENCE TO RELATED APPLICATION

This application is based on and claims priority under 35 USC 119 from Japanese Patent Application No. 2009-080549 filed Mar. 27, 2009.

BACKGROUND

1. Field of the Invention

The present invention relates to a charging member, a process cartridge and an image forming apparatus.

2. Related Art

In an image forming apparatus using an electrophotographic process, first, a surface of an image holding member including a photoconductive photoreceptor made of an inorganic or organic material is charged using a charging apparatus. Laser beam modulated with an image signal is irradiated thereon to form an electrostatic latent image. Thereafter, charged toner is used to develop the electrostatic latent image to form a visualized toner image. Then, the toner image is electrostatically transferred via an intermediate transfer body or directly onto a transfer material such as recording paper, followed by fixing on a recording material to obtain a required reproduction image.

A charging apparatus is an apparatus that plays the role of charging a body to be charged such as an image holding member. The charging apparatus is categorized largely into two types, one of which is a contact charging apparatus that comes into contact directly with an image holding member to charge the image holding member, and the other of which is a non-contact charging apparatus that, without coming into contact with the image holding member, charges the image holding member by applying corona discharge in the proximity of the image holding member. In recent years, charging apparatus that adopt a contact charging process that is free from a byproduct such as ozone or nitrogen oxide generated by discharging are increasing.

A contact charging apparatus includes a charging member that comes into contact directly with a surface of an image holding member and rotates following movement of the surface of the image holding member to charge the image holding member.

When the charging member is used to charge the image holding member, a toner or an external additive of the toner on the image holding member frequently attaches to the charging member. In some cases, such an attachment causes a fluctuation in a surface resistance of the charging member to render charging property unstable.

In this connection, for the purpose of inhibiting the toner or the external additive of the toner from attaching, a technique in which a specific material is used in the outermost layer of the charging member has been proposed As an characteristic of the contact charging apparatus, improvement in endurance for continuously charging a body to be charged with less fluctuation is demanded. In the contact charging process, when an AC current applied to the charging apparatus is reduced to minimize damage caused by discharge to a photoreceptor, there is a concern that fluctuation in charging becomes larger. Accordingly, in order to inhibit a white spot or a black spot caused by fluctuation in the charging from occurring while reducing damage to an image holding member, a technique in which resin particles are contained in the outermost layer to make a surface irregular to improve uniformity of charging has been proposed.

SUMMARY

According to an aspect of the invention, a charging member including at least: a base material; and a conductive outermost layer that is disposed on the base material, comes into contact with a body to be charged, has a ten-point average surface roughness Rz of about 2 μm to about 20 μm, and contains (A) a resin and (B) specific conductive particles for forming the surface roughness, the charging member coining into contact with the body to be charged, in a state where a voltage is applied, to charge the body to be charged, is provided.

BRIEF DESCRIPTION OF THE DRAWINGS

Exemplary embodiments of the present invention will be described in detail based on the following figures, wherein.

DETAILED DESCRIPTION

Exemplary embodiments of the invention are described in detail hereinafter.

A charging member of the exemplary embodiment includes at least: a base material; and a conductive outermost layer that is disposed on the base material, comes into contact with a body to be charged, has a surface roughness Rz of 2 μm to 20 μm or about 2 μm to about 20 μm, and contains (A) a resin and (B) specific conductive particles for forming the surface roughness, the charging member coming into contact with the body to be charged, in a state where a voltage is applied to charge the body to be charged. In the exemplary embodiment, the "conductive outermost layer" includes outermost layers having a conductive property and a semiconductive property.

In what follows, an exemplary embodiment that is one example of the invention will be described with reference to the drawings.

(Charging Member)

Figure 1:
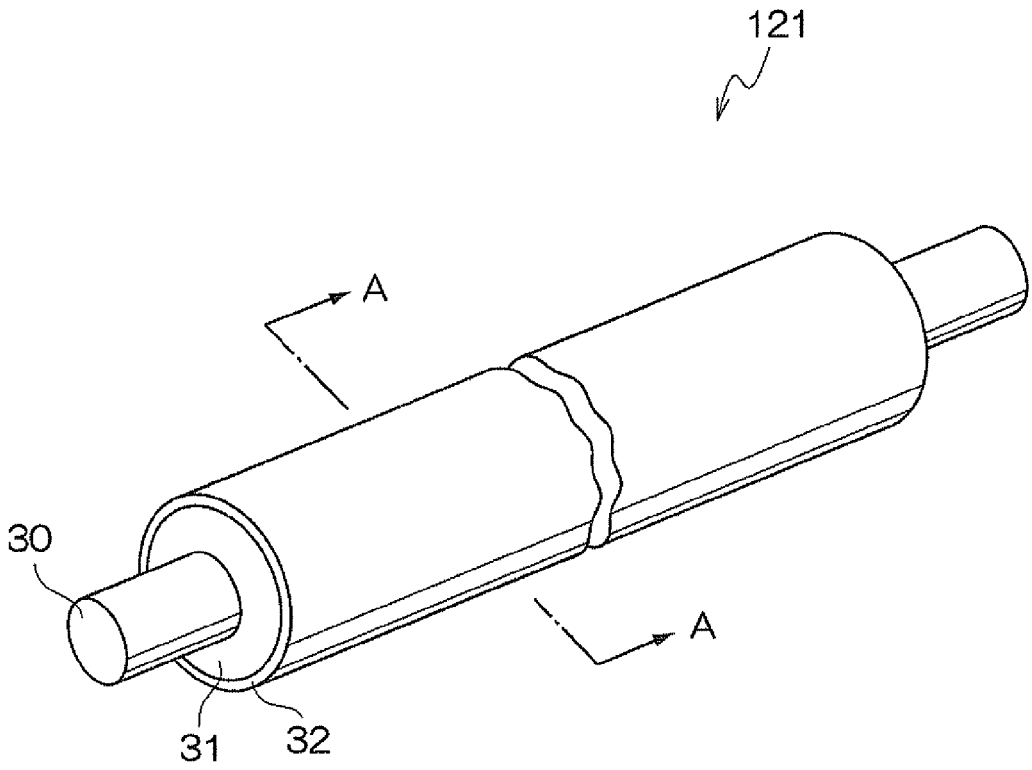
FIG. 1 is a schematic perspective view showing a charging member according to an exemplary embodiment of the present invention.
Figure 2:
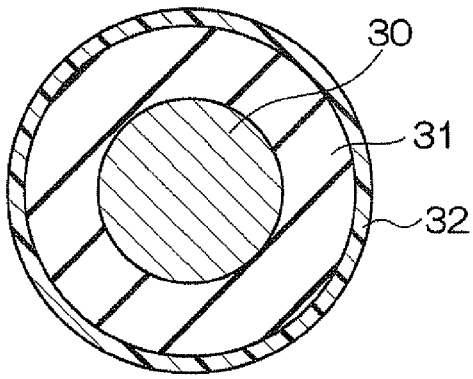
FIG. 2 is a schematic sectional view of a charging member according to an exemplary embodiment of the present invention.

FIG. 1 is a schematic perspective view showing a charging member according to the exemplary embodiment. FIG. 2 is a schematic sectional view of a charging member according to the exemplary embodiment. FIG. 2 is an A-A sectional view of FIG. 1.

A charging member 121 according to the exemplary embodiment of the invention is, as shown in FIGS. 1 and 2, a roll member including, for example, a shaft 30 (core body), an conductive elastic layer 31 disposed on an outer peripheral surface of the shaft 30, and a conductive outermost layer 32 disposed on an outer peripheral surface of the conductive elastic layer 31.

Herein, a form of a roll member will be described as an example. However, a shape of a charging member may be a roll, brush, belt (tube) or blade shape without restricting to particular one. Among these, a roll member that will be described in the exemplary embodiment is preferable, that is, a shape of a charging roll is preferable.

The conductive property in the present specification means a volume resistivity at 20° C. of less than 1×10 Ωcm. Furthermore, the semiconductive property in the present specification means a volume resistivity of from 1×10 Ωcm to $1\times10^{10}$ Ωcm.

The charging member 121 according to the exemplary embodiment of the invention may have, without restricting to the foregoing configuration, a form that does not have a conductive elastic layer 31, or a configuration having an intermediate layer disposed between the conductive elastic layer 31 and the shaft 30, a resistance control layer or a migration preventive layer disposed between the conductive elastic layer 31 and the conductive outermost layer 32, or a coating layer (protective layer) disposed outside (outermost surface) of the conductive outermost layer 32. Furthermore, the charging member 121 according to the exemplary embodiment may have a form constituted of a shaft 30 and a conductive outermost layer 32.

The charging member 121 used is constituted by containing a conductive material, for example, metal or alloy such as aluminum, copper alloy or stainless steel; chromium or nickel-plated iron; or a conductive resin.

A base material in the exemplary embodiment of the invention works as an electrode and a support member of a charging roll, and a material thereof include, for example, metal such as iron (free-cutting steel), copper, brass, stainless steel, aluminum or nickel. In the exemplary embodiment, the shaft 30 is a conductive bar-like member. Examples of the shaft 30 include a member (for example, resin or ceramic member) having a plated outer peripheral surface and a member (for example, resin or ceramic member) in which a conductive agent is dispersed. The shaft 30 may be formed into a hollow member (tubular member) or a non-hollow member.

The conductive elastic layer 31 is constituted by containing, for example, an elastic material, a conductive agent, and, as required, other additives. The conductive elastic layer 31 is a layer formed directly on an outer peripheral surface of the shaft 30 as required.

Examples of the elastic material include isoprene rubber, chloroprene rubber, epichlorohydrin rubber, butyl rubber, polyurethane, silicone rubber, fluororubber, styrene-butadiene rubber, butadiene rubber, nitrile rubber, ethylene propylene rubber, epichlorohydrin-ethylene oxide copolymer rubber, epichlorohydrin-ethylene oxide-allyl glycidyl ether copolymer rubber, ethylene-propylene-diene ternary copolymer rubber (EPDM), acrylonitrile-butadiene copolymer rubber (NBR), natural rubber and blends thereof. Among these, polyurethane, silicone rubber, EPDM, epichlorohydrin-ethylene oxide copolymer rubber, epichlorohydrin-ethylene oxide-allyl glycidyl ether copolymer rubber, NBR and blends thereof are preferably used. These elastic materials may be a foamed type or a non-foamed type.

As the conductive agent, an electron-conductive agent and an ion-conductive agent are cited. Examples of the electron-conductive agent include powders of, for example, carbon black such as Ketjen black or acetylene black; pyrolytic carbon, graphite; various kinds of conductive metals or alloys such as aluminum, copper, nickel, or stainless steel; various kinds of conductive metal oxides such as tin oxide, indium oxide, titanium oxide, tin oxide-antimony oxide solid solution, or tin oxide-indium oxide solid solution; or insulating materials having a conductive surface. Examples of the ion-conductive agent include perchlorate or chlorate of an ammonium compound such as tetraethyl ammonium or lauryl trimethyl ammonium; perchlorate or chlorate of alkali metal or alkaline metal such as lithium or magnesium.

The conductive agents may be used alone or in a combination of at least two of them.

Specific examples of the carbon black include "SPECIAL BLACK 350", "SPECIAL BLACK 100", "SPECIAL BLACK 250", "SPECIAL BLACK 5", "SPECIAL BLACK 4", "SPECIAL BLACK 4A", "SPECIAL BLACK 550", "SPECIAL BLACK 6", "COLOR BLACK FW200", "COLOR BLACK FW2", and "COLOR BLACK FW2V" (trade name, all manufactured by Degussa Inc.), and "MONARCH 1000", "MONARCH 1300", "MONARCH 1400", "MOGUL-L" and "REGAL 400R" (trade name, all manufactured by Cabot Corporation).

A particle diameter of the conductive agent is preferably 1 nm to 200 nm. An average particle diameter is measured according to a method shown below.

That is, the conductive agent is observed using an electron microscope, diameters of 100 particles thereof are measured, followed by averaging the diameters to obtain an average particle diameter. In the specification, a value obtained according to the method is used.

Furthermore, a particle diameter may be measured using, for example, ZETA SIZER NANO ZS (trade name, manufactured by Sysmex Corporation).

An addition amount of the conductive agent is not particularly restricted. However, in the case of the electron-conductive agent, an addition amount of the conductive agent is preferably in a range of from 1 part by weight to 30 parts by weight, and more preferably in a range of from 15 parts by weight to 25 parts by weight with respect to 100 parts by weight of the elastic material. On the other hand, in the case of the ion-conductive agent, an addition amount of the ion-conductive agent is preferably in a range of from 0.1 parts by weight to 5.0 parts by weight, and more preferably in a range of from 0.5 parts by weight to 3.0 parts by weight with respect to 100 parts by weight of the elastic material.

Examples of other additives blended in the conductive elastic layer 31 include materials that are usually added to an elastic layer, for example, a softener, a plasticizer, a hardener, a vulcanizing agent, a vulcanization accelerator, an antioxidant, a surfactant, a coupling agent, or a filler (silica or calcium carbonate).

When a conductive elastic layer 31 is formed, a mixing method or a mixing order of the respective components such as a conductive agent, an elastic material and other components (a vulcanizing agent or a foaming agent added as required) is not particularly restricted. As a method generally used, a method where all components are mixed in advance in a tumbler or a V-blender, followed by melting and mixing in an extruder, further followed by extrusion molding is used.

A thickness of the conductive elastic layer 31 is preferably set at substantially 1 mm to 10 mm and more preferably at substantially 2 mm to 5 mm. The volume resistivity of the elastic layer is preferably $10^3$ Ωcm to $10^{14}$ Ωcm.

(Conductive Outermost Layer)

The charging member 121 in the exemplary embodiment of the invention (a charging member of the exemplary embodiment) is constituted by including a base material; and a conductive outermost layer 32 that is disposed on the base material, comes into contact with a body to be charged, has a surface roughness Rz in a range of from 2 μm to 20 μm or in a range of from about 2 μm to about 20 μm, and contains (A) a resin, (B) specific conductive particles for imparting irregularities (the specific surface roughness) to a surface of the conductive outermost layer 32 (outer peripheral surface of a charging member 121), as required, (C) conductive particles having an average particle diameter smaller than that of the (B) specific conductive particles, particles, and other additives.

[(A) Resin]

As the resin, a resin capable of forming a resin film constituting the outermost layer is selected.

Examples of resin capable of forming the outermost layer include a polyamide resin, a polyvinyl acetal resin, an acrylic resin, a polyester resin, a phenol resin, an epoxy resin, a melamine resin and a benzoguanamine resin.

Copolymer nylon (AMILAN CM8000: trade name, manufactured by TODAY INDUSTRIES, INC.) as well is preferably cited. At least one species of 610 nylon, 11 nylon, and 12 nylon is contained as a polymerization unit and 6 nylon and 66 nylon are cited as another polymerization unit contained in the copolymer. As the resin, the elastic material blended in the conductive elastic layer 31 may be applied.

These may be used alone or in a combination of at least two species of them. A polyamide resin is contained as a main component of the resin from the viewpoint of effects.

The polyamide resin is excellent in the adhesive property with a toner and an external additive and difficult to cause friction charging to charge the body to be positive charged when coming into contact with the body to be charged; accordingly, the toner or external additive is inhibited from attaching to the charging member.

The polyamide resin usable in the exemplary embodiment is not particularly restricted. All polyamide resins described in "Polyamide Resin Handbook" (edited by Osamu Fukumoto, published by THE NIKKANKOGYO SHIMBUN LTD.), 8400 are used. Among these, alcohol-soluble polyamide is preferable.

As the alcohol-soluble polyamide, N-alkoxymethylated polyamide is preferable, and N-methoxymethylated polyamide (N-methoxymethylated nylon (trade name: TREJIN, manufactured by Nagase ChemteX Corporation)) is more preferable.

Examples of the polyvinyl acetal resin usable as a resin include a polyvinyl butyral resin, a polyvinyl formal resin and a partially acetalized polyvinyl butyral resin where butyral is partially modified with formal or acetoacetal.

As the polyester resin, a polyester resin containing a constituent derived from an acid and a constituent derived from an alcohol is used and as required other components may be contained.

The polyester resin is synthesized from an acid (dicarboxylic acid) component and an alcohol (diol) component. In the specification, the "constituent derived from an acid" means a constituent site that was an acid component before synthesis of the polyester resin, and the "constituent derived from an alcohol" means a constituent site that was an alcohol component before synthesis of the polyester resin.

In what follows, the respective components usable in the synthesis of the polyester resin will be described.

—Constituent Derived from Acid—

As an acid that produces the constituent derived from an acid, aliphatic dicarboxylic acid is preferable and straight chain carboxylic acid is particularly preferable. Examples thereof include oxalic acid, malonic acid, succinic acid, glutaric acid, adipic acid, pimelic acid, suberic acid, azelic acid, sebacic acid, 1,9-nonanedicarboxylic acid, 1,10-decanedicarboxylic acid, 1,11-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, 1,18-octadecanedicarboxylic acid, lower alkyl esters thereof, and acid-anhydrides thereof, without restricting thereto.

As the constituent derived from an acid, other than the constituents derived from aliphatic dicarboxylic acids, a constituent such as a constituent derived from dicarboxylic acid having a double bond or a constituent derived from dicarboxylic acid having a sulfonate group is preferably contained.

The constituent derived from dicarboxylic acid having a double bond includes, other than the constituent derived from dicarboxylic acid having a double bond, a constituent derived from a lower alkyl ester or acid anhydride of dicarboxylic acid having a double bond as well. Furthermore, the constituent derived from dicarboxylic acid having a sulfonate group includes, other than the constituent derived from dicarboxylic acid having a sulfonate group, a constituent derived from a lower alkyl ester or acid hydride of dicarboxylic acid having a sulfonate group as well.

As the dicarboxylic acid having a double bond, dicarboxylic acid is preferable and examples of the dicarboxylic acid include fumaric acid, maleic acid, 3-hexenedioic acid, and 3-octenedioic acid, without restricting thereto. Furthermore, lower alkyl esters thereof and acid anhydrides thereof are cited as well. Among these, fumaric acid and maleic acid are preferable from the viewpoint of the cost.

—Constituent Derived from Alcohol—

Examples of alcohol that produces to the constituent derived from an alcohol include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,20-eicosanediol, without restricting thereto.

As other constituent contained as required, a constituent derived from diol having a double bond and a constituent derived from diol having a sulfonate group are cited.

As the diol having a double bond, 2-butene-1,4-diol, 3-butene-1,6-diol and 4-butene-1,8-diol are cited.

As the diol having a sulfonate group, sodium benzene 1,4-hydroxy-2-sulfonate, sodium benzene 1,3-dihydroxymethyl-5-sulfonate, and 2-sulfo-1,4-butanediol sodium salt are cited.

The polyester resin usable as a resin in the exemplary embodiment is synthesized according to a standard method with the constituent derived from an acid and the constituent derived from an alcohol.

Examples of the phenol resin usable as a resin of the exemplary embodiment preferably include monomers of monomethylolphenols, dimethylolphenols, trimethylolphenols and mixtures thereof, oligomers obtained therefrom, and mixtures of the monomers and oligomers, which are obtained by reacting a compound having a phenol structure such as resorcin, bisphenol, a substituted phenol containing one hydroxy group such as phenol, cresol, xylenol, p-alkylphenol, or p-phenylphenol, a substituted phenol containing two hydroxy groups such as catechol, resorcinol, or hydroquinone, bisphenols such as bisphenol A or bisphenol Z, or biphenols, with formaldehyde or p-formaldehyde under presence of an acid or alkali catalyst.

The epoxy resin usable as a resin in the exemplary embodiment means all monomers, oligomers and polymers, which have two or more epoxy groups in a molecule thereof. The molecular weight and molecular structure thereof are not particularly restricted. Examples of the epoxy resin include a biphenyl epoxy resin, a bisphenol epoxy resin, a stilbene epoxy resin, a phenol novolac epoxy resin, a cresol novolac epoxy resin, a triphenolmethane epoxy resin, an alkyl-modified triphenolmethane epoxy resin, a triazine skeleton-containing epoxy resin, a dicyclopentadiene-modified phenol epoxy resin, and a phenolaralkyl epoxy resin (having a phenylene skeleton or diphenylene skeleton). These may be used alone or in a mixture thereof.

Among these, a biphenyl epoxy resin, a bisphenol epoxy resin, a stilbene epoxy resin, a phenol novolac epoxy resin, a cresol novolac epoxy resin and a triphenolmethane epoxy resin are preferable, a biphenyl epoxy resin, a bisphenol epoxy resin, a phenol novolac epoxy resin and a cresol novolac epoxy resin are more preferable, and a bisphenol epoxy resin is particularly preferable.

As the melamine resin or benzoguanamine resin usable as a resin of the exemplary embodiment, known compounds having a guanamine structure or a melamine structure are used. For example, compounds represented by Formulas (A) or (B) shown below are cited. The compound represented by Formula (A) or Formula (B) is synthesized with guanamine or melamine and formaldehyde according to a known method (see, for example, "Experimental Chemical Lectures (Jikken Kagaku Kouza)", 4$^{th}$ edition, vol. 28, page. 430). Specifically, structures shown below are cited. These may be used alone or in a mixture thereof. However, these are preferably used by mixing or as an oligomer from the viewpoint of improving the solubility.

(A)

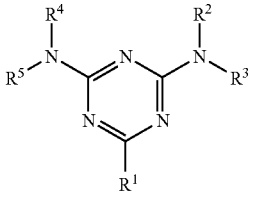

In Formula (A), $R^1$ represents a straight chain or branched alkyl group having 1 to 10 carbon atoms, a substituted or unsubstituted phenyl group having 6 to 10 carbon atoms, or a substituted or unsubstituted alicyclic hydrocarbon group having 4 to 10 carbon atoms. $R^2$ to $R^5$ each independently represent a hydrogen atom, —$CH_2$—OH, or —$CH_2$—$OR^{6a}$. $R^{6a}$ represents a straight chain or branched alkyl group having 1 to 10 carbon atoms.

In what follows, specific examples of the compound represented by Formula (A) will be shown without restricting thereto. Specific examples shown below include monomers. However, polymers (oligomers) having these as a structural unit may be used as well.

(A)-1

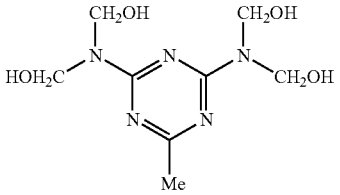

-continued (A)-2

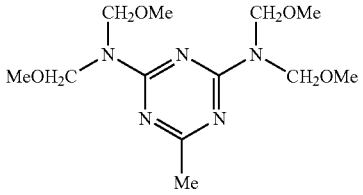

(A)-3

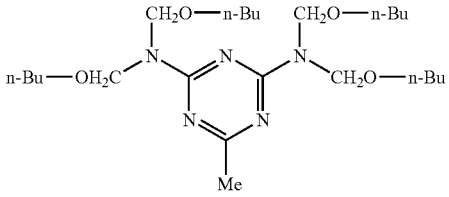

(A)-4

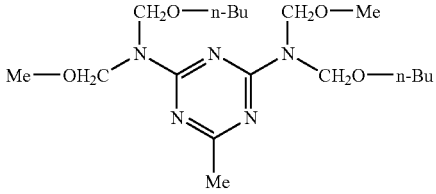

(A)-5

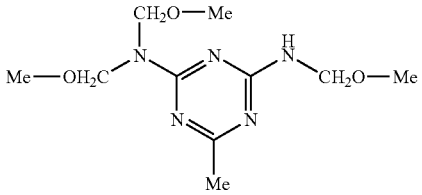

(A)-6

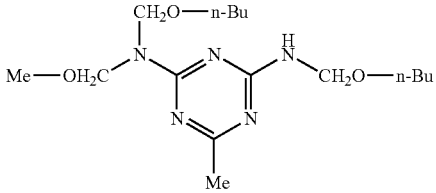

(A)-7

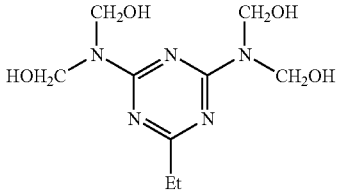

(A)-8

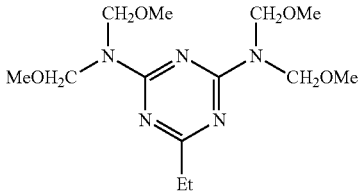

(A)-9

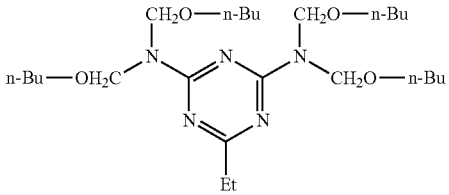

-continued
(A)-10
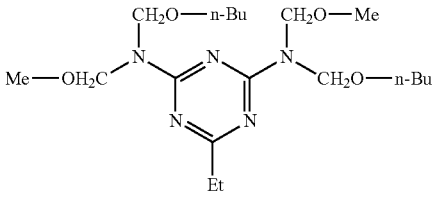
(A)-11
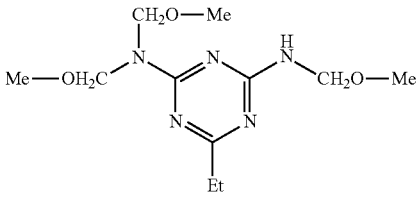
(A)-12
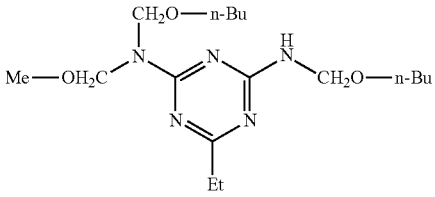
(A)-13
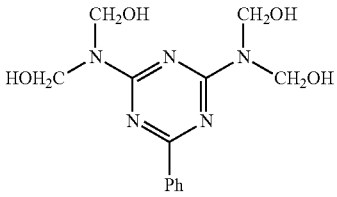
(A)-14
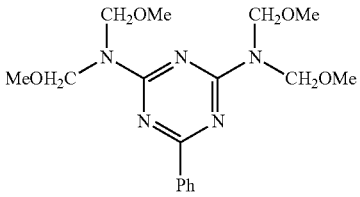
(A)-15
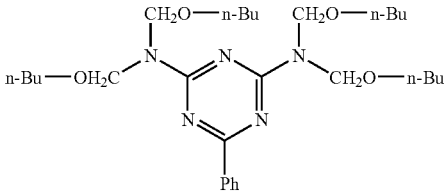
(A)-16
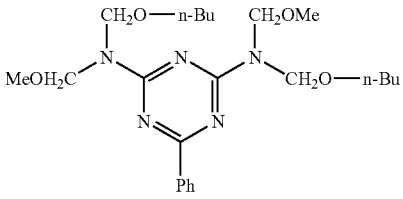
(A)-17
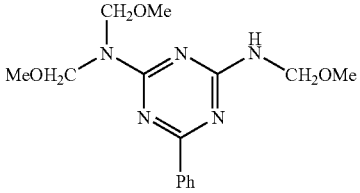
-continued
(A)-18
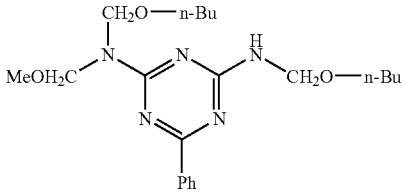
(A)-19
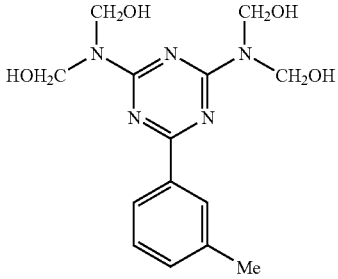
(A)-20
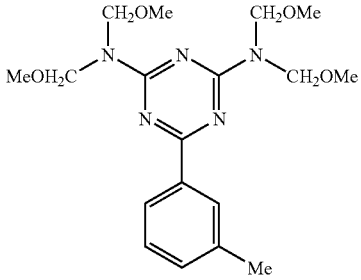
(A)-21
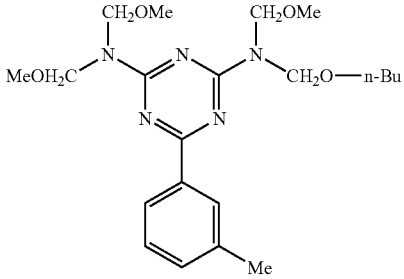
(A)-22
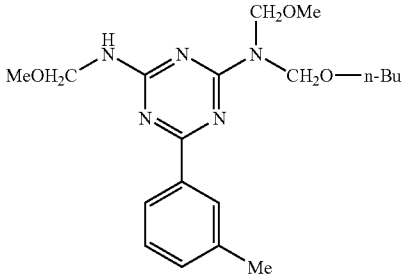
(B)
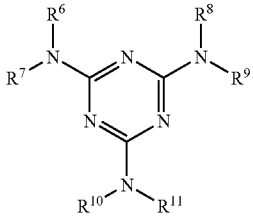
In Formula (B), $R^6$ to $R^{11}$ each independently represent a hydrogen atom, —$CH_2$—OH, or —$CH_2$—$OR^{12}$. $R^{12}$ represents a straight chain or branched alkyl group having 1 to 5 carbon atoms. The alkyl group represented by $R^{12}$ includes a methyl group, an ethyl group, a butyl group or the like.

The compound represented by Formula (B) is synthesized with, for example, melamine and formaldehyde according to a known method (synthesized in a manner essentially similar to that for a melamine resin described in "Experimental Chemical Lectures (Jikken Kagaku Kouza)", $4^{th}$ edition, vol. 28, page. 430).

In what follows, specific examples of the compound represented by Formula (B) will be shown without restricting thereto. Specific examples shown below include monomers. However, polymers (oligomers) having these as a structural unit may be used as well.

(B)-1

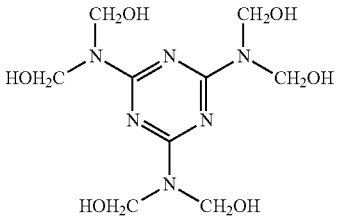

(B)-2

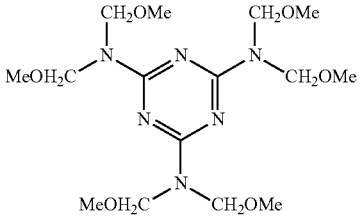

(B)-3

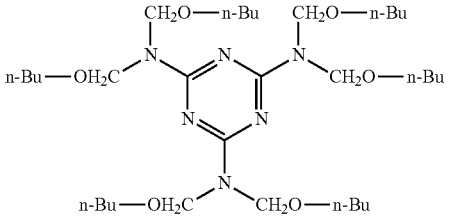

(B)-4

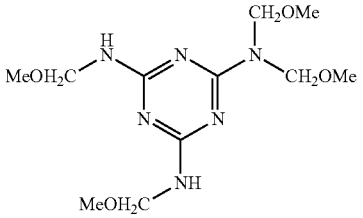

(B)-5

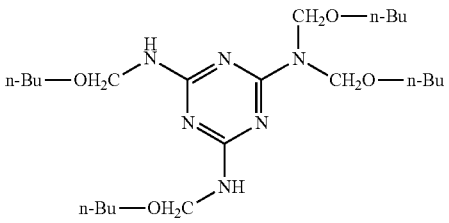

-continued (B)-6

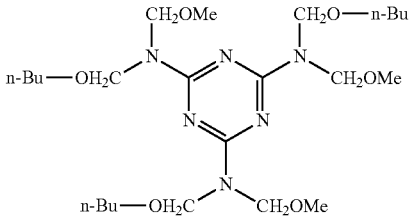

(B)-7

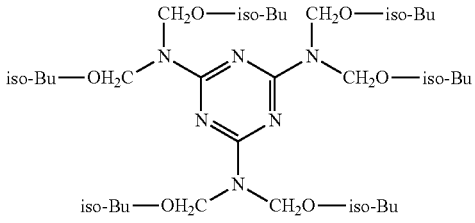

The guanamine resin and melamine resin are commercially available. Examples thereof include SUPER BECKAMINE® L-148-55, SUPER BECKAMINE® 13-535, SUPER BECKAMINE® L-145-60, and SUPER BECKAMINE® TD-126 (trade name, all manufactured by DIC Corporation), NIKALAC BL-60 and NIKALAC BX-4000 (trade name, all manufactured by Nippon Carbide Industries Co., Inc.) (all products shown above are guanamine resin), SUPERMERAMI No. 90 (trade name, manufactured by NOF CORPORATION), SUPER BECKAMINE® TD-139-60 (trade name, manufactured by DIC Corporation), YUBAN 2020 (trade name, manufactured by Mitsui Chemicals, Inc.), SUMITEX RESIN M-3 (trade name, manufactured by Sumitomo Chemical Co., Ltd.) and NIKALAC MW-30 (trade name, manufactured by Nippon Carbide Industries Co., Ltd.). The commercial products may be used as it is.

In the charging member 121 according to the exemplary embodiment, a ten point-average surface roughness Rz of a surface thereof (a surface of the conductive outermost layer 32 imparted by specific conductive particles 32B) is necessarily in a range of from 2 μm to 20 μm, or in a range of from about 2 μm to about 20 μm, preferably in a range of from 3 μm to 12 μm, more preferably in a range of from 7 μm to 12 μm, and particularly preferably in a range of from 10 μm to 12 μm. When the surface roughness is set in this range, chargeability free from fluctuation is imparted and foreign matters such as toner or external additives become difficult to attach to the conductive outermost layer 32 to result in additional effect of high contamination resistance. When the ten point-average surface roughness Rz is less than 2 μm, foreign matters such as toner or external additives attach in some cases. On the other hand, when the ten point-average surface rough ness Rz is larger than 20 μm, toner or paper powder tends to stay in irregularities and local abnormal discharge tends to occur to result in image defects such as white clarity.

The ten point-average surface roughness Rz is the surface roughness defined in HS B0601 (1994). The ten point-average surface roughness Rz is measured using a surface roughness meter. In the invention, the surface roughness is measured using a contact surface roughness meter (trade name: SURFCOM 570A, manufactured by TOKYO SEIMITU CO., LTD.) under an environment of 23° C. and 55% RH. When the surface roughness is measured, a measurement distance is set at 2.5 mm, a contact stylus having a diamond tip (5 μmR, 90° cone) is used, a measurement is repeated three times with a position varying, followed by averaging the measured values, thereby a ten point-average surface roughness Rz is obtained.

[(B) Specific Conductive Particles for Forming Surface Roughness]

The conductive outermost layer contains (B) specific conductive particles for forming surface roughness (hereinafter, appropriately, referred to as (B) specific conductive particles), for forming the above surface roughness Rz. That is, when the outermost layer is formed by containing the (B) specific conductive particles in the (A) resin, on a surface of the outermost layer, surface irregularities are formed along particle diameters of the (B) specific conductive particles. Owing to the irregularities, the conductive outermost layer preferably comes into contact with the body to be charged, and, the (B) specific conductive particles per se that form irregularities are conductive; accordingly, charging caused by the particles is effectively inhibited from fluctuating.

Examples of a material constituting the (B) specific conductive particles include, for example, carbon black, graphite, carbon particles obtained by baking a phenol resin, metal particles and particles of metal oxide. Any one of these may be used in the exemplary embodiment.

The conductive property in the (B) specific conductive particles means a volume resistivity of less than 10 Ωcm and the (B) specific conductive particles are appropriately selected from the materials having the volume resistivity.

Among the (B) specific conductive particles, metal particles or particles of metal oxide are large in the specific gravity; accordingly, there is fear of irregular surface caused by sedimentation upon coating on a surface of the charging member. Accordingly, particles formed from a material having a specific gravity of 2 g/cm$^3$ or less, or about 2 g/cm$^3$ or less, and more preferably in a range of from 0.1 g/cm$^3$ to 2 g/cm$^3$ or in a range of from about 0.1 g/cm$^3$ to about 2 g/cm$^3$, are preferable. Examples of the conductive particles having such specific gravity include fine particles of amorphous carbon obtained by baking phenol resin particles (trade name: UNIBEX GCP, manufactured by Unitika Ltd.) and carbon and graphite spherical fine particles (trade name: NICABEADS ICB, NICABEADS MC, NICABEADS PC, manufactured by Nippon Carbon Co., Ltd.).

A shape and particle diameter of the (B) specific conductive particles are preferable to be an aspect shown below.

(Shape)

An average degree of circularity of the (B) specific conductive particles according to the exemplary embodiment of the invention is preferably in a range of from 0.8 to 1.0 or in a range of from about 0.8 to about 1.0.

The average degree of circularity is measured using a flow type particle image analyzer FPIA-3000 (trade name, manufactured by Sysmex Corporation).

The degree of circularity is obtained according to the following equation.

Degree of circularity=a boundary length of a circle having an area same as a projected area of a particle/a boundary length of a particle=$[2\times(A\pi)^{1/2}]/PM$ (Wherein, A represents a projected area and PM represents a boundary length.)

The degree of circularity is measured of 5000 particles, followed by averaging the measured values, and this is taken as an average degree of circularity.

As shown in the degree of circularity, the (B) specific conductive particles are preferable to have a spherical shape or a shape close to sphere. When the (B) specific conductive particles have the above shape, a thickness of the (A) resin present on a surface of the (B) specific conductive particles is more inhibited from fluctuating in comparison with an angular amorphous particle shape, and thereby a body to be charged is charged with less fluctuation.

(Particle Diameter)

A volume average particle diameter of the specific conductive particles according to the exemplary embodiment of the invention is preferably in a range of from 2 μm to 20 μm or from about 2 μm to about 20 μm, more preferably in a range of from 3 μm to 15 μm, and even more preferably in a range of from 3 μm to 12 μm.

When the (B) specific conductive particles satisfying such an average shape factor and a volume average particle diameter like this are used, the surface roughness described above is attained. Accordingly, the resulting charging member is inhibited from causing contamination owing to attachment of the toner or external additive and may impart charging free from fluctuation over a long period of time.

[(C) Conductive Particles Having Average Particle Diameter Smaller than that of (B) Specific Conductive Particles for Forming Surface Roughness]

The conductive outermost layer contains (C) conductive particles having an average particle diameter smaller than that of the (B) specific conductive particles (hereinafter, in some cases, referred to as (C) a conductive agent) from the viewpoint of increasing the conductive property of the conductive outermost layer according to the exemplary embodiment. As the (C) conductive agent, the conductive agents used in the conductive elastic layer may be similarly used. A preferable particle diameter of the (C) conductive agent is as mentioned above.

As the conductive agent blended in the conductive outermost layer 32, the conductive agents blended in the conductive elastic layer 31 are similarly cited.

Furthermore, as the other additives, materials that are usually added to a surface layer such as a conductive agent, a softener, a plasticizer, a hardener, a vulcanizing agent, a vulcanization accelerator, an antioxidant, a surfactant, and a coupling agent are cited.

As contents of the respective components in the conductive outermost layer, the content of the (A) resin is 20% by weight to 99% by weight, and preferably 10% by weight to 95% by weight, (B) specific conductive particles is 1% by weight to 50% by weight, and preferably 3% by weight to 45% by weight, and the content of the (C) conductive agent added as required is 1% by weight to 50% by weight, and preferably 1% by weight to 30% by weight.

A solid content in a coating solution composition is preferably 5% by weight to 50% by weight from the viewpoints of inhibiting the layer thickness and the dispersion state of the (B) specific conductive particles from fluctuating.

As a method for forming a conductive outermost layer, any one of a dip method, a spray method, a vacuum deposition method and a plasma coating method may be used to form on a base material. However, a dip method is preferable from the viewpoint of simplicity of a producing process.

A drying condition of the resulting coating solution layer is determined depending on species and quantities of the resin and catalyst used. However, a drying temperature is preferably 40° C. to 200° C. and more preferably 50° C. to 180° C. A drying time is preferably 5 min to 5 hr and more preferably 10 min to 3 hr.

As a drying method, hot air drying is cited.

[Catalyst]

For the purpose of promoting curing of the conductive outermost layer according to the exemplary embodiment of the invention, a catalyst may be used. As the curing catalyst, an acid catalyst is preferably used.

Examples of the acid catalyst include aliphatic carboxylic acid such as acetic acid, chloroacetic acid, trichloroacetic acid, trifluoroacetic acid, oxalic acid, maleic acid, malonic acid, or lactic acid; aromatic carboxylic acid such as benzoic acid, phthalic acid, terephthalic acid or trimelitic acid; and aliphatic and aromatic sulfonic acids such as methanesulfonic acid, dodecylsulfonic acid, benzenesulfonic acid, dodecylbenzenesulfonic acid, or naphthalenesulfonic acid. A sulfur-containing material is preferably used.

Examples of organic sulfonic acid and/or derivative thereof include p-toluenesulfonic acid, dinonylnaphthalenesulfonic acid (DNNSA), dinonylnaphthalenedisulfonic acid (DNNDSA), dodecylbenzenesulfonic acid and phenolsulfonic acid. Among these, preferable are p-toluenesulfonic acid and dodecylbenzenesulfonic acid from the viewpoints of catalytic activity and film-forming property. A salt of organic sulfonic acid as well may be used, as long as it is dissolvable to some extent in the conductive outermost layer forming coating solution composition.

When a so-called heat latent catalyst that exhibits an increased degree of catalytic activity when a temperature of a certain degree or more is applied is used, catalytic ability becomes lower at a liquid storage temperature and higher during curing; accordingly, lowering of a curing temperature and storage stability may be combined.

Examples of the heat latent catalyst include particulate microcapsules obtained by coating an organic sulfone compound with a polymer, porous compounds such as zeolite onto which an acid is adsorbed, heat latent protonic acid catalysts in which a protonic acid and/or a derivative thereof are blocked with a base, protonic acid and/or a derivative thereof esterified with a primary or secondary alcohol, a protonic acid and/or a derivative thereof blocked with vinyl ether and/or vinyl thioether, monoethyl amine complexes of boron trifluoride, and pyridine complexes of boron trifluoride.

Among these, protonic acid and/or derivative thereof that are blocked with a base are preferably used from the viewpoints of catalytic activity, storage stability, availability and cost efficiency.

Examples of the protonic acid of the heat latent protonic acid catalyst include sulfuric acid, hydrochloric acid, acetic acid, sulfuric acid, formic acid, nitric acid, phosphoric acid, sulfonic acid, monocarboxylic acid, polycarboxylic acid, propionic acid, oxalic acid, benzoic acid, acrylic acid, methacrylic acid, itaconic acid, phthalic acid, maleic acid, benzenesulfonic acid, o-toluenesulfonic acid, m-toluenesulfonic acid, p-toluenesulfonic acid, styrenesulfonic acid, dinonylnaphthalenesulfonic acid, dinonylnaphthalenedisulfonic acid, decylbenzenesulfonic acid, undecylbenzenesulfonic acid, tridecylbenzenesulfonic acid, tetradecylbenzenesulfonic acid and dodecylbenzenesulfonic acid. Examples of the protonic acid derivatives include neutralized alkali metal salts or alkaline earth metal salts of protonic acids such as sulfonic acid and phosphoric acid, and polymers in which a protonic acid skeleton is incorporated into a polymer chain thereof (for example, polyvinylsulfonic acid). Examples of the base that blocks the protonic acid include amines.

The amines are classified into primary, secondary, and tertiary amines. In the invention, any one of these amines may be used without particular restriction.

Examples of the primary amine include methylamine, ethylamine, propylamine, isopropylamine, n-butylamine, isobutylamine, t-butylamine, hexylamine, 2-ethylhexylamine, sec-butylamine, allylamine, methylhexylamine and the like. Examples of the secondary amine include dimethylamine, diethylamine, di-n-propylamine, diisopropylamine, di-n-butylamine, diisobutylamine, di-t-butylamine, dihexylamine, di(2-ethylhexyl)amine, N-isopropyl-N-iosbutylamine, di-sec-butylamine, diallylamine, N-methylhexylamine, 3-pipecoline, 4-pipecoline, 2,4-lupetidine, 2,6-lupetidine, 3,5-lupetidine, morpholine, N-methylbenzylamine and the like.

Examples of the tertiary amine include trimethylamine, diethylamine, tri-n-propylamine, triisopropylamine, tri-n-butylamine, triisobutylamine, tri-t-butylamine, trihexylamine, tri(2-ethylhexyl)amine, N-methylmorpholine, N,N-dimethylallylamine, N-methyldiallylamine, triallylamine, N,N,N',N'-tetramethyl-1,2-diaminoethane, N,N,N',N'-tetramethyl-1,3-diaminopropane, N,N,N',N'-tetraallyl-1,4-diaminobutane, N-methylpiperidine, pyridine, 4-ethylpyridine, N-propyldiallylamine, 3-dimethylaminopropanol, 2-ethylpyrazine, 2,3-dimethylpyrazine, 2,5-dimethylpyrazine, 2,4-lutidine, 2,5-lutidine, 3,4-lutidine, 3,5-lutidine, 2,4,6-collidine, 2-methyl-4-ethylpyridine, 2-methyl-5-ethylpyridine, N,N,N',N'-tetramethylhexamethylenediamine, N-ethyl-3-hydroxypiperidine, 3-methyl-4-ethylpyridine, 3-ethyl-4-methylpyridine, 4-(5-nonyl)pyridine, imidazole, N-methylpiperazine and the like.

Examples of the commercially available products usable as the heat latent catalyst in the exemplary embodiment include NACURE 2501 (toluenesulfonic acid dissociation, methanol/isopropanol solvent, pH: 6.0 to 7.2, dissociation temperature: 80° C.), NACURE 2107 (p-toluenesulfonic acid dissociation, isopropanol solvent, pH: 8.0 to 9.0, dissociation temperature: 90° C.), NACURE 2500 (p-toluenesulfonic acid dissociation, isopropanol solvent, pH: 6.0 to 7.0, dissociation temperature: 65° C.), NACURE 2530 (p-toluenesulfonic acid dissociation, methanol/isopropanol solvent, pH: 5.7 to 6.5, dissociation temperature: 65° C.), NACURE 2547 (p-toluenesulfonic acid dissociation, aqueous solution, pH: 8.0 to 9.0, dissociation temperature: 107° C.), NACURE 2558 (p-toluene sulfonic acid dissociation, ethylene glycol solvent, pH: 3.5 to 4.5, dissociation temperature: 80° C.), NACURE XP-357 (p-toluenesulfonic acid dissociation, methanol solvent, pH: 2.0 to 4.0, dissociation temperature: 65° C.), NACURE XP-386 (p-toluenesulfonic acid dissociation, aqueous solution, pH: 6.1 to 6.4, dissociation temperature: 80° C.), NACURE XC-2211 (p-toluenesulfonic acid dissociation, pH: 7.2 to 8.5, dissociation temperature: 80° C.), NACURE 5225 (dodecylbenzenesulfonic acid dissociation, isopropanol solvent, pH: 6.0 to 7.0, dissociation temperature: 120° C.), NACURE 5414 (dodecylbenzenesulfonic acid dissociation, xylene solvent, dissociation temperature: 120° C.), NACURE 5528 (dodecylbenzenesulfonic acid dissociation, isopropanol solvent, pH: 7.0 to 8.0, dissociation temperature: 120° C.), NACURE 5925 (dodecylbenzenesulfonic acid dissociation, pH: 7.0 to 7.5, dissociation temperature: 130° C.), NACURE 1323 (dinonylnaphthalenesulfonic acid dissociation, xylene solvent, pH: 6.8 to 7.5, dissociation temperature: 150° C.), NACURE 1419 (dinonylnaphthalenesulfonic acid dissociation, xylene/methyl isobutyl ketone solvent, dissociation temperature: 150° C.), NACURE 1557 (dinonylnaphthalenesulfonic acid dissociation, butanol/2-butoxyethanol solvent, pH: 6.5 to 7.5, dissociation temperature: 150° C.), NACURE X49-110 (dinonylnaphthalenedisulfonic acid dissociation, isobutanol/isopropanol solvent, pH: 6.5 to 7.5, dissociation temperature: 90° C.), NACURE 3525 (dinonylnaphthalenedisulfonic acid dissociation, isobutanol/isopropanol solvent, pH: 7.0 to 8.5, dissociation temperature: 120° C.), NACURE XP-383 (dinonylnaphthalenedisulfonic acid dissociation, xylene solvent, dissociation temperature: 120° C.), NACURE 3327 (dinonylnaphthalenedisulfonic acid dissociation, isobutanollisopropanol solvent, pH: 6.5 to 7.5, dissociation temperature: 150° C.), NACURE 4167 (phosphoric acid dissociation, isopropanol/isobutanol solvent, pH: 6.8 to 7.3, dissociation temperature: 80° C.), NACURE XP-297 (phosphoric acid dissociation, water/isopropanol solvent, pH: 6.5 to 7.5, dissociation temperature: 90° C.), and NACURE 4575 (phosphoric acid dissociation, pH: 7.0 to 8.0, dissociation temperature: 110° C.) (trade name; all manufactured by King Industries).

The heat latent catalysts may be used alone or in a combination of at least two of them.

A blending amount of the heat latent catalyst is preferably 0.01% by weight to 20% by weight, and particularly preferably 0.1% by weight to 10% by weight, with respect to 100 parts of a solid content in the resin solution. When the blending amount exceeds 20% by weight, the catalyst may deposit as foreign matters after baking treatment, and when the blending amount is less than 0.01% by weight, the catalytic activity may be lowered.

When the catalyst is added, the conductive outermost layer of the exemplary embodiment forms a high density crosslinked structure to be high in the mechanical strength to result in excellent endurance. As a measure for detecting preferable physical properties of the conductive outermost layer, a gel fraction is cited. That is, the gel fraction of the formed conductive outermost layer is preferably 50% or more.

The gel fraction in the exemplary embodiment is measured according to JIS K6796.

Specifically, a conductive outermost layer forming coating solution composition obtained by dissolving a conductive outermost layer material in a solvent is coated on an aluminum plate by use of a bar coater to form a film having a thickness of a coating solution of 100 μm, followed by thoroughly drying, further followed by heating and curing at a curing temperature and a curing time corresponding to species of the resin and catalyst contained in the coating solution. After cooling to room temperature (25° C.), a weight of the prepared conductive outermost layer is measured and taken as a weight of a material before solvent extraction.

In the next place, the conductive outermost layer is dipped for 24 hr in a solvent used to prepare the coating solution, followed by filtering the solvent, further followed by thoroughly filtering a remained conductive outermost layer resin film, followed by measuring a weight. The weight is taken as a weight after extraction.

A degree of crosslinking is calculated according to the following equation.

$$\text{Gel Fraction}=100\times(\text{weight after extraction})/(\text{weight before solvent extraction}) \quad \text{(Equation)}$$

When the calculated degree of crosslinking is 50% or more, crosslinking density of the polymer in the conductive outermost layer is increased and the film is judged excellent in the crack resistance.

Only the outermost layer portion is cut out from a charging member as a measurement sample and supplied to measure.

A film thickness of the conductive outermost layer 32 is preferably thicker when the friction endurance as the charging member is considered. However, when the film thickness is excessively thick, charging performance to a latent image holding member tends to decrease. Accordingly, the film thickness is selected in the range of from 0.01 μm to 1000 μm and specifically preferably in the range of from 3 μm to 25 μm. The volume resistivity of a surface layer is preferably in the range of $10^3$ Ωcm to $10^{14}$ Ωcm.

According to the foregoing method, a charging member of the exemplary embodiment, which has a conductive outermost layer on a base material, is obtained.

The charging member 121 according to the exemplary embodiment is produced, for example, in such a manner that an elastic layer 31 and a conductive outermost layer 32 are sequentially formed on an outer peripheral surface of a shaft 30 by use of, for example, a blade coating method, a Meyer bar coating method, a spray coating method, a dip coating method, a bead coating method, an air-knife coating method, or a curtain coating method.

(Charging Apparatus)

Figure 3:
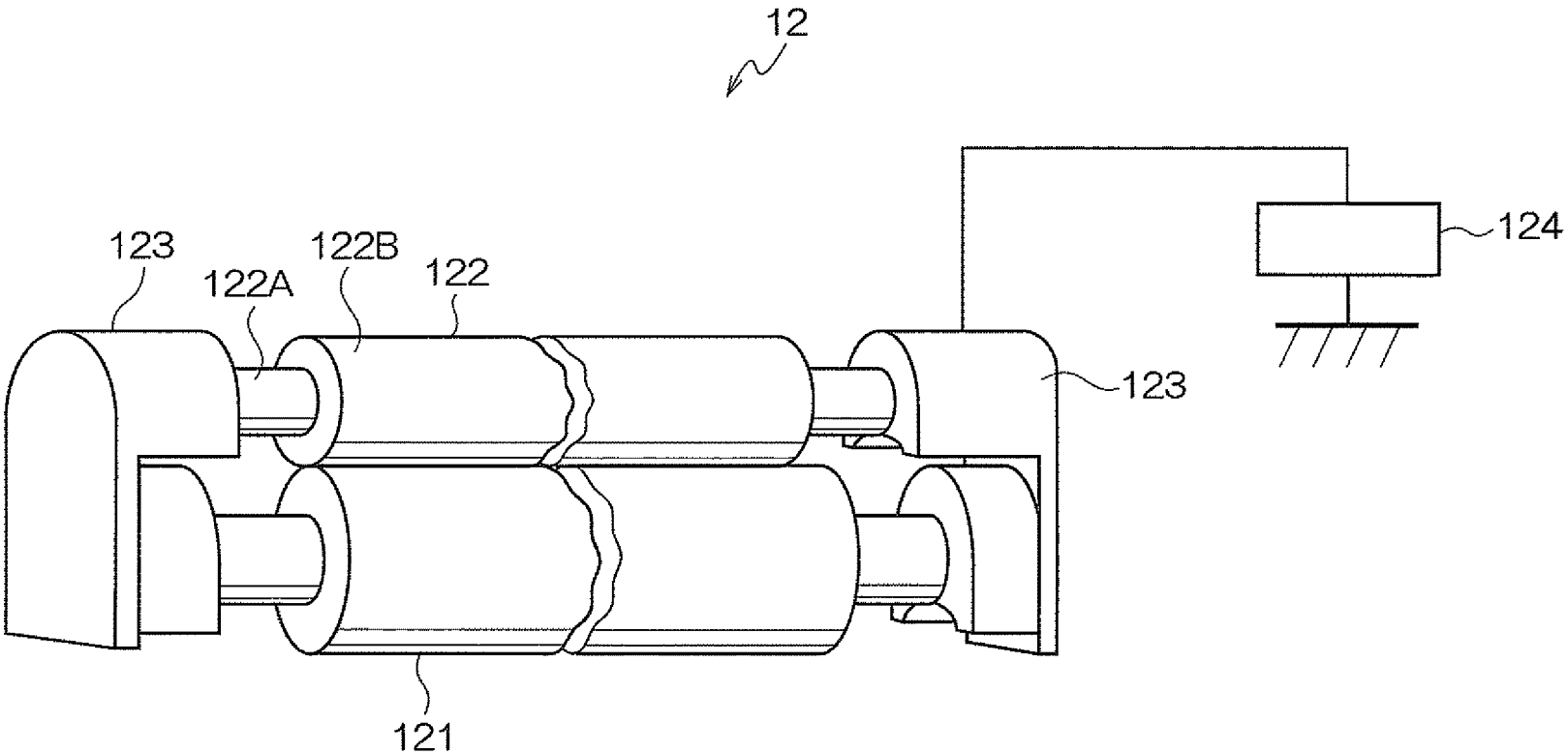
FIG. 3 is a schematic perspective view of a charging apparatus according to an exemplary embodiment of the present invention.

In what follows, a charging apparatus according to the exemplary embodiment of the invention will be described. FIG. 3 is a schematic perspective view of a charging apparatus according to the exemplary embodiment of the invention. The charging apparatus according to the exemplary embodiment is provided with the charging member according to the exemplary embodiment of the invention as a charging member.

In the charging apparatus 12 according to the exemplary embodiment, as shown in FIG. 3, for example, a charging member 121 and a cleaning member 122 are disposed in contact with each other at a specific biting amount. Both ends in an axial direction of each of a shaft 30 of the charging member 121 and a shaft 122A of a cleaning member 122 are held by a conductive bearing 123 so that the respective members may be freely rotated. On one side of the conductive bearing 123, a power supply 124 is connected. The charging apparatus according to the exemplary embodiment may not have, for example, a cleaning member 122 without restricting to the foregoing configuration.

The cleaning member 122 is a cleaning member for cleaning a surface of the charging member 121 and is formed into, for example, a roll. The cleaning member 122 is constituted of, for example, a shaft 122A and an elastic layer 122E formed on an outer peripheral surface of the shaft 122A.

The shaft 122A is a conductive bar-like member. Examples of a material thereof include metals such as iron (free-cutting steel), copper, brass, stainless steel, aluminum and nickel. Examples of the shaft 122A include as well a member (for example, resin, ceramic member) having a plated outer peripheral surface and a member (for example, resin, ceramic member) in which a conductive agent is dispersed. The shaft 122A may be formed into a hollow member (tubular member) or a non-hollow member.

The elastic layer 122B is made of a foam having porous three-dimensional structure, and preferably has voids or irregular portions (hereinafter referred to as a cell) inside or on a surface thereof and the elasticity. The elastic layer 122B is formed by containing a foaming resin material or rubber material such as polyurethane, polyethylene, polyamide, olefin, melamine or polypropylene, NBR (acrylonitrile-butadiene copolymer rubber), EPDM (ethylene-propylene-diene copolymer rubber), natural rubber, styrene/butadiene rubber, chloroprene, silicone or nitrile.

Among the foaming resin materials or rubber materials, polyurethane that is strong in tearing strength and tensile strength is particularly preferably used from the viewpoints of being capable of efficiently cleaning foreign matters such as toner or external additives by driven sliding with the charging member 121, making it difficult to bruise a surface of the charging member 121 by friction of the cleaning member 122, and making it difficult to be broken or damaged over a long period of time.

Examples of the polyurethane include, without particular restriction reaction products between polyol (for example, polyester polyol, polyether polyester, acryl polyol) and isocyanate (for example, 2,4-tolylene diisocyanate, 2,6-tolylene diisocyanate or 4,4-diphenylmethane diisocyanate, tolidine diisocyanate, or 1,6-hexamethylene diisocyanate). Reaction products obtained by lengthening a chain thereof with a chain extender (for example, 1,4-butanediol, trimethylol propane) may be used. The polyurethane is generally foamed using a foaming agent (water, azo compounds (azodicarbonamide or azobisisobutyronitrile).

A number of cells of the elastic layer 122B is preferably 20/25 mm to 80/25 mm, more preferably 30/25 mm to 80/25 mm and even more preferably 30/25 mm to 50/25 mm. Herein, the number of cells is referred to a cell number per a length of 25 mm For example, 20/25 mm means that there are 20 cells per a length of 25 mm.

The hardness of the elastic layer 122B is preferably 100 N to 500 N, more preferably 100 N to 400 N, and particularly preferably 150 N to 400 N.

The conductive bearing 123 is a member that holds the charging member 121 and the cleaning member 122 in one piece and freely rotatably and keeps a distance between shafts of the respective members. The conductive bearing 123 may be formed of any material and in any shape as long as it is produced from a conductive material. For example, a conductive bearing or a conductive sliding bearing may be applied.

The power supply 124 is an apparatus that applies a voltage to the conductive bearing 123 to charge the charging member 121 and the cleaning member 122 in the same polarity. An existing a high-voltage power supply may be used.

In the charging apparatus 12 according to the exemplary embodiment of the invention, a voltage is supplied from the power supply 124 to the conductive bearing 123 to charge the charging member 121 and the cleaning member 122 in the same polarity. Thereby, the foreign matters (for example, toner or external additive) on a surface of the image holding member are inhibited from depositing on a surface of the cleaning member 122 and charging member 121, rendered to return to the surface of the image holding member and are recovered by the cleaning apparatus of the image holding member. Accordingly, contamination is inhibited from depositing on the charging member 121 and cleaning member 122 over a long period of time, and thereby the charging property is maintained.

(Image Forming Apparatus, Process Cartridge)

An image forming apparatus according to the exemplary embodiment includes: an image holding member; a charging unit that charges the image holding member; a latent image forming unit that forms a latent image on a surface of the charged image holding member; a developing unit that develops the latent image formed on a surface of the image holding member to form a toner image; and a transferring unit that transfers the toner image formed on a surface of the image holding member onto a transfer receiving body (recording medium). The charging apparatus according to the exemplary embodiment of the invention is applied as a charging unit (charging apparatus).

A process cartridge according to the exemplary embodiment of the invention is formed detachable from, for example, the image forming apparatus having the foregoing configuration and includes an image holding member and a charging unit which comes into contact with the image holding member and charges the image holding member. As the charging unit, the charging apparatus according to the exemplary embodiment of the invention is applied. The process cartridge according to the exemplary embodiment may include, as required, at least one selected from the group consisting of a developing unit that develops a latent image formed on a surface of the image holding member with a toner to form a toner image, a transferring unit that transfers the toner image formed on a surface of the image holding member onto a recording medium and a cleaning unit that removes a residual toner on the surface of the image holding member after transferring.

Figure 4:
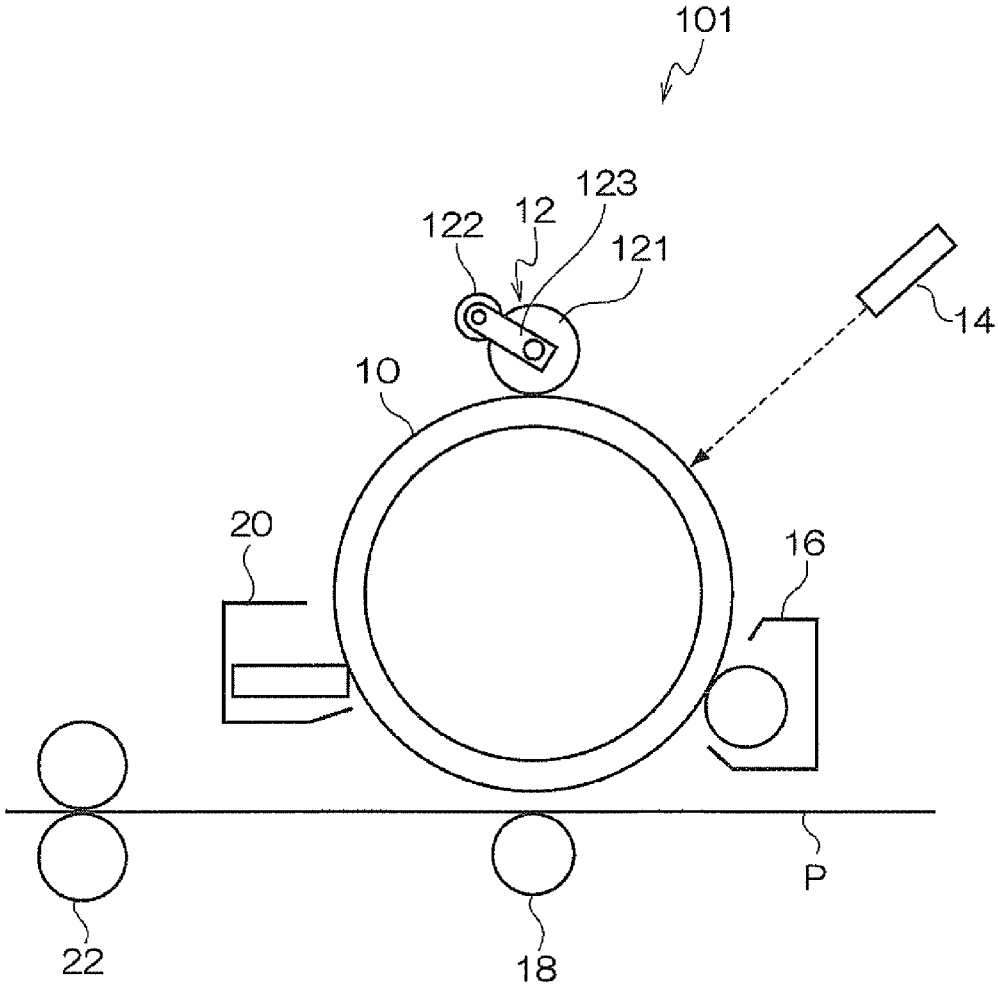
FIG. 4 is a schematic configuration view showing an image forming apparatus according to an exemplary embodiment of the present invention.
Figure 5:
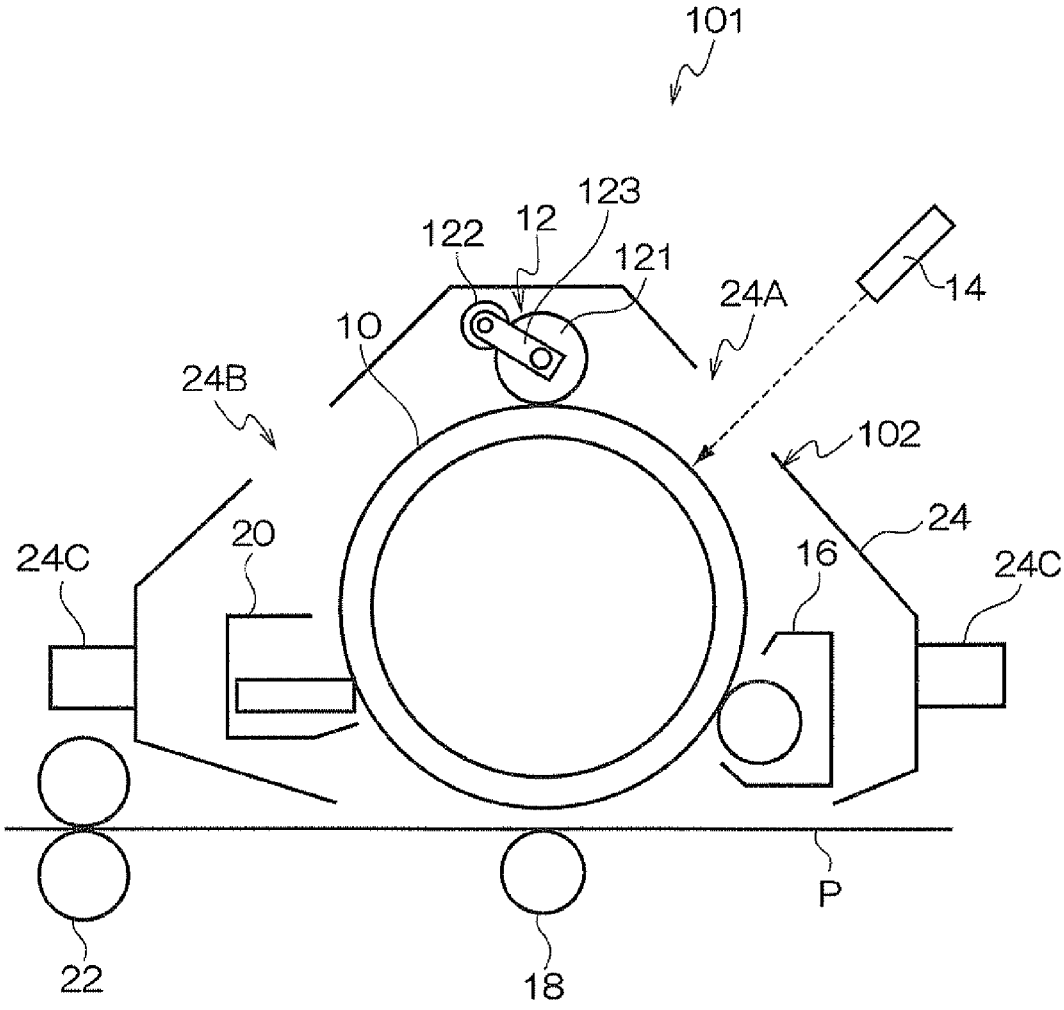
FIG. 5 is a schematic configuration view showing a process cartridge according to an exemplary embodiment of the present invention.

In the next place, the image forming apparatus and process cartridge of the exemplary embodiment of the invention, will be described with reference to the drawings. FIG. 4 is a schematic configuration view showing the image forming apparatus according to the exemplary embodiment of the invention. FIG. 5 is a schematic configuration view of the process cartridge according to the exemplary embodiment of the invention.

An image forming apparatus 101 according to the exemplary embodiment includes, as shown in FIG. 4, an image holding member 10 and, around the image holding member, a charging apparatus 12 that charges the image holding member, a pressure member that presses the charging member 121 so that a force pressing the charging member 121 toward the image holding member 10 acts in a direction of a normal line to a contact surface between the image holding member and the charging member; an exposing apparatus 14 that exposes the image holding member 10 charged by the charging apparatus 12 to form a latent image, a developing apparatus 16 that develops the latent image formed by the exposing apparatus 14 with a toner to form a toner image, a transferring apparatus 18 that transfers the toner image formed by the developing apparatus 16 on a recording medium P, and a cleaning apparatus 20 that removes a residual toner on the surface of the image holding member 10 after the transferring. Furthermore, the image forming apparatus 101 includes a fixing apparatus 22 that fixes the toner image transferred on the recording medium P by the transferring apparatus 18.

The image forming apparatus 101 according to the exemplary embodiment includes, as the charging apparatus 12, a charging apparatus according to the exemplary embodiment of the invention that includes, for example, a charging member 121, a cleaning member 122 disposed in contact with the charging member 121, a conductive bearing 123 for holding both ends in an axial direction of the charging member 121 and cleaning member 122 so that the respective members may freely rotate, and a power supply 124 connected to one of the conductive bearing 123.

In the image forming apparatus 101 of the exemplary embodiment, as the configuration other than the charging apparatus 12 (charging member 121), a configuration known as the respective configurations of an existing electrophotographic image forming apparatus is applied. In what follows, one example of the respective configurations will be described.

As the image holding member 10, a known photoreceptor is applied without particular restriction. An organic photoreceptor having a so-called function separation type, in which a charge generating layer and a charge transporting layer are separated, is suitably applied. Furthermore, an image holding member 10 having a surface layer covered with a protective layer having charge transportability and a crosslinked structure is preferably applied. A photoreceptor including a siloxane resin, a phenol resin, a melamine resin, a guanamine resin or an acryl resin as a crosslinking component of the protective layer is preferably applied as well.

As the exposing apparatus 14, for example, a laser optical system or a LED array may be applied.

The developing apparatus 16 is a developing apparatus that brings, for example, a developing agent holding member having a developing agent layer formed on a surface thereof into contact with or in proximity to the image holding member 10 to attach a toner to a latent image on a surface of the image holding member 10 form a toner image. As a developing method of the developing apparatus 16, a developing method that uses a two-component developing agent as a conventionally known method is preferably applied. The developing method that uses a two-component developing agent included, for example, a cascade method and a magnetic brush method.

As the transferring apparatus 18, any one of, for example, a non-contact transferring method such as Corotron and a contact transferring method that brings a conductive transfer roll through a recording medium P into contact with the image holding member 10 to transfer a toner image on the recording medium P may be applied.

The cleaning apparatus 20 is a member that brings, for example, a cleaning blade into contact directly with a surface of the image holding member 10 to remove toner, paper powder or dirt attached on a surface. As the cleaning apparatus 20, other than the cleaning blade, a cleaning brush or a cleaning roll may be applied.

As the fixing apparatus 22, a heating and fixing apparatus that uses a heat roll is preferably applied. The heating and fixing apparatus includes, for example, a heating heater lamp inside of a cylindrical core metal, and, on an outer peripheral surface thereof, a fixing roller having on an outer peripheral surface thereof a so-called separation layer formed of a heat-resistant resin coated layer or a heat-resistant rubber coated layer, and a pressure roller or a pressure belt that is disposed in contact with the fixing roller under specific contact pressure and provided with a heat-resistant elastic layer on an outer peripheral surface of the cylindrical core metal or on a surface of a belt-like base material. In a fixing process of an unfixed toner image, a recording medium P on which an unfixed toner image is transferred is inserted between, for example, a fixing roller and a pressure roller or a pressure belt to perform fixing by thermally fusing a binder resin or additive in the toner.

The image forming apparatus 101 according to the exemplary embodiment may be, without restricting to the foregoing configuration, for example, an image forming apparatus according to an intermediate transfer method that makes use of an intermediate transfer body or a so-called tandem image forming apparatus in which image forming units forming toner images of the respective colors are disposed side by side.

The process cartridge according to the exemplary embodiment is a process cartridge 102 configured in such a manner that, as shown in FIG. 5, in the image forming apparatus shown in FIG. 4, an image holding member 10, a charging apparatus 12 that charges the image holding member, a developing apparatus 16 that develops a latent image formed by the exposing apparatus 14 to develop with a toner to form a toner image and a cleaning apparatus 20 that removes a toner remained on a surface of the image holding member 10 after transferring are integrally combined and held by a chassis 24 provided with an opening 24A for exposure, an opening 24B for deelectrifying exposure and an attachment rail 24C. The process cartridge 102 is incorporated freely detachably from the image forming apparatus 101 shown in FIG. 4.

EXAMPLES

In what follows, the present invention will be described based on Examples. However, the invention is not restricted by Examples shown below. Unless stated clearly, "parts" means "parts by weight".

<Preparation of Photoreceptor 1>

In the beginning, a horned cylindrical aluminum base material having an outer diameter ϕ of 84 mm is prepared. In the next place, 100 parts by weight of a zirconium compound (trade name: ORGATICKS ZC-540, manufactured by Matsumoto Pharmaceutical Manufacture Co., Ltd.), 10 parts by weight of a silane compound (trade name: A-1100, manufactured by Nippon Unicar Company Limited), 400 parts by weight of isopropanol and 200 parts by weight of butanol are mixed, and thereby a coating solution for forming an undercoat layer is obtained.

The coating solution is coated by dipping on an aluminum base material, followed by heating and drying at 150° C. for 10 min, and thereby an undercoat layer having a thickness of 0.1 μm is formed.

In the next place, 1 part by weight of hydroxygallium phthalocyanine having strong diffraction peaks at 7.5°, 9.9°, 12.5°, 16.3°, 18.6°, 25.1° and 28.3° by Bragg angle (2θ±0.2°) in a CuKα characteristic X-ray diffraction spectrum, 1 part by weight of polyvinyl butyral (trade name: S-LEC BM-S, manufactured by Sekisui Chemical Co., Ltd.) and 100 parts by weight of n-butyl acetate are mixed, followed by dispersing together with glass beads in a paint shaker for 1 hr, thereby a coating solution for forming a charge generating layer is obtained.

The coating solution is coated by dipping on the undercoat layer, followed by heating and drying at 100° C. for 10 min, and thereby a charge generating layer having a film thickness of substantially 0.15 μm is formed.

In the next place, 2 parts by weight of a charge transporting material represented by the following Formula (V-3), 3 parts by weight of a polymer (viscosity average molecular weight: 50,000) having a structural unit represented by the following Formula (V-4) and 20 parts by weight of chlorobenzene are mixed, and thereby a coating solution for forming a charge transporting layer is obtained.

(V-3)

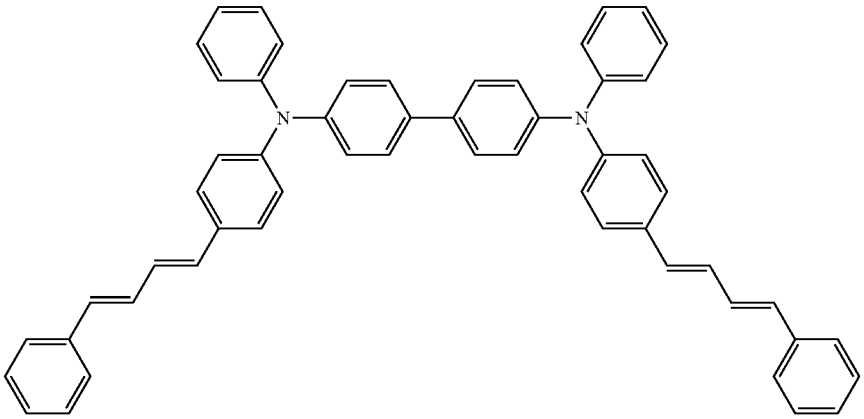

-continued (V-4)

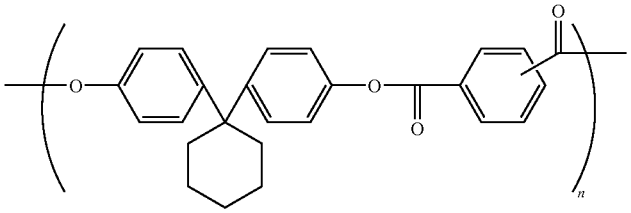

The resulting coating solution for forming a charge transporting layer is coated by dipping on the charge generating layer, followed by heating at 110° C. for 40 min, and thereby a charge transporting layer having a film thickness of 20 μm is formed. A photoreceptor in which the undercoat layer, the charge generating layer and the charge transporting layer are formed on a surface roughened aluminum base material like this will be referred to as "photoreceptor 1".

<Preparation of Photoreceptor 2>

In the beginning, 7 parts by weight of a resol type phenol resin (trade name: PL-2211, manufactured by Gun Ei Chemical Industry Co., Ltd.) and 0.03 parts by weight of methylphenyl polysiloxane are prepared. These are dissolved in 15 parts by weight of isopropanol and 5 parts by weight of methyl ethyl ketone, and thereby a coating solution for forming a protective layer is obtained.

The coating solution is coated by dipping on the photoreceptor 1, followed by heating and drying at 130° C. for 40 min, and thereby a protective layer having a thickness of 3 μm is formed. The resulting photoreceptor will be referred to as "photoreceptor 2".

<Preparation of Cleaning Member>

In the beginning, polyurethane EP70 (trade name, manufactured by Inoac Corporation) is cut into a magnitude of 20 mm×20 mm×250 mm and is used as a cleaning pad a for a charging member.

Furthermore, a core material formed from SUS 303 and having an outer diameter ϕ of 5 mm and a length of 230 mm is inserted in the cleaning pad a, followed by bonding the core material and the cleaning pad a formed from a urethane foam with a hot-melt adhesive, further followed by cutting off the cleaning pad a up to a position of respectively 5 mm from both ends of the core material, and thereby an elastic roll material is obtained. The elastic roll material is polished and thereby a cleaning roll a for a charging member which has an outer diameter ϕ of 9 mm is obtained.

Furthermore, a cleaning roll b for a charging member is obtained in a manner similar to the process in the preparation of the cleaning roll a except that the urethane foam used is changed to polyurethane RSC (trade name, manufactured by Inoac Corporation).

<Formation of Charging Roll>

—Formation of Conductive Elastic Layer—

A mixture having a composition shown in the table shown below is kneaded by use of an open roll, followed by forming, by use of a press molding machine, a roll having a diameter of 15 mm via an adhesive layer on a surface of a conductive support made of SUS 303 and having a diameter of 8 mm, further followed by polishing to obtain conductive elastic rolls A and B having a diameter of 14 mm. A blending amount shown below is based on "parts by weight".

TABLE 1

| Material species | | Composition of conductive elastic roll A Blending amount | Composition of conductive elastic roll B Blending amount |
|---|---|---|---|
| Elastic material | Epichlorohydrin rubber | 95.6 | 75 |
| | Nitrilebutadiene rubber | 4.4 | 25 |
| Conductive agent | Benzyltriethylammonium chloride | 0.9 | 0.9 |
| | Carbon black | 15 | 10 |
| Vulcanizing agent | Sulfur | 0.5 | 0.5 |
| Vulcanization accelerator | Lithium tetramethyl/disulfide | 1.5 | 1.5 |
| | dibenzothiazolyl disulfide | 1.5 | 1.5 |
| Filler | Calcium carbonate | 20 | 20 |
| Vulcanization accelerator | Stearic acid | 1 | 1 |
| | Zinc oxide | 5 | 5 |

EXAMPLE 1

Formation of Conductive Outermost Layer

A dispersion is obtained by diluting a mixture having a composition shown below with methanol, followed by dispersing the resulting solution using a beads mill. The dispersion is coated by dipping on a surface of the conductive elastic roll A, followed by heating and drying at 180° C. for 30 min, to form a surface layer having a film thickness of 7 μm, and thereby a charging member (charging roll 1) of example 1 is obtained.

The charging member is incorporated in an image forming apparatus that incorporates the photoreceptor 1, and thereby an image forming apparatus is obtained.

—Composition—

| | |
|---|---|
| (A) Resin (N-methoxymethylated nylon 1, trade name: F30K, manufactured by Nagase ChemteX Corporation) | 100 parts by weight |
| (B) Specific conductive particles (conductive filler-1) (trade name: NICABEADS PC0520, manufactured by Nippon Carbon Co., Ltd., volume average particle diameter: 6.7 μm, average degree of circularity: 0.95) | 30 parts by weight |
| (C) Conductive agent (trade name: CARBON BLACK MONAHRCH 1000, manufactured by Cabot Corporation, volume average particle diameter: 43 nm) | 17 parts by weight |
| Catalyst | 4.4 parts by weight |

EXAMPLE 2

A conductive roll 2 is obtained by forming a conductive outermost layer in a manner substantially similar to that in Example 1 except that conductive filler 2 (trade name: NICABEADS PC1020, manufactured by Nippon Carbon Co., Ltd., volume average particle diameter: 13 μm, average degree of circularity: 0.93) is used as the (B) specific conductive particles.

EXAMPLE 3

A conductive roll 3 is obtained by forming a conductive outermost layer in a manner substantially similar to that in Example 1 except that conductive filler 3 (trade name: NICABEADS MC0520, manufactured by Nippon Carbon Co., Ltd., volume average particle diameter: 6.7 μm, average degree of circularity: 0.98) is used as the (B) specific conductive particles.

EXAMPLE 4

A conductive roll 4 is obtained by forming a conductive outermost layer in a manner substantially similar to that in Example 1 except that conductive filler 4 (trade name: NICABEADS MC1020, manufactured by Nippon Carbon Co., Ltd., volume average particle diameter: 13.9 tam, average degree of circularity: 0.98) is used as the (B) specific conductive particles.

EXAMPLE 5

A conductive roll 5 is obtained by forming a conductive outermost layer in a manner substantially similar to that in Example 1 except that conductive filler 5 (trade name: NICABEADS MC0520, manufactured by Nippon Carbon Co., Ltd., volume average particle diameter: 6.7 μm, average degree of circularity: 0.81) is used as the (B) specific conductive particles.

EXAMPLE 6

A conductive roll 3 is obtained by forming a conductive outermost layer in a manner substantially similar to that in Example 1 except that conductive filler 6 (trade name: NICABEADS MC0520, manufactured by Nippon Carbon Co., Ltd., volume average particle diameter: 6.7 μM, average degree of circularity: 0.75) is used as the (B) specific conductive particles.

EXAMPLE 7

The conductive roll 1 obtained in Example 1 is incorporated in an image forming apparatus where the photoreceptor 2 is incorporated in place of the photoreceptor 1, and thereby an image forming apparatus is obtained.

EXAMPLE 8

A conductive roll 8 is obtained by forming an outermost conductive layer in a manner substantially similar to that in Example 1 except that the conductive elastic roll A on which the conductive outermost layer is formed is replaced with a conductive elastic roll B.

EXAMPLE 9

The conductive roll 1 obtained in Example 1 is incorporated in an image forming apparatus where the cleaning roll b is incorporated in place of the cleaning roll a, and thereby an image forming apparatus is obtained.

EXAMPLE 10

The conductive roll 1 obtained in Example 1 is incorporated in an image forming apparatus where the cleaning pad a is incorporated in place of the cleaning roll a, and thereby an image forming apparatus is obtained.

EXAMPLE 11

A conductive roll 11 is obtained by forming a conductive outermost layer in a manner substantially similar to that in Example 1 except that an addition amount of the (B) specific conductive particles is changed from 30 parts by weight to 5 parts by weight.

EXAMPLE 12

A conductive roll 12 is obtained by forming a conductive outermost layer in a manner substantially similar to that in Example 1 except that an addition amount of the (B) specific conductive particles is changed from 30 parts by weight to 50 parts by weight and conductive filler 2 (trade name: NICABEADS PC1020, manufactured by Nippon Carbon Co., Ltd., volume average particle diameter: 13 μm, average degree of circularity: 0.93) is used as the (B) specific conductive particles.

EXAMPLE 13

A conductive roll 13 is obtained by forming an outermost conductive layer in a manner substantially similar to that in Example 1 except that the (A) resin is blended as shown below.

| | |
|---|---|
| N-methoxymethylated nylon 1 (trade name: F30K, manufactured by Nagase ChemteX Corporation) | 90 parts by weight |
| Polyvinyl acetal resin (trade name: S-LEC BL-1, manufactured by Sekisui Chemical Co., Ltd.) | 10 parts by weight |

EXAMPLE 14

A conductive roll 14 is obtained by forming an outermost conductive layer in a manner substantially similar to that in Example 1 except that the (A) resin is blended as shown below.

| | |
|---|---|
| N-methoxymethylated nylon 1 (trade name: F30K, manufactured by Nagase ChemteX Corporation) | 90 parts by weight |
| Melamine resin (trade name: MW30M, manufactured by Sanwa Chemical Co., Ltd.) | 10 parts by weight |

COMPARATIVE EXAMPLE 1

A conductive roll C1 is obtained by forming a conductive outermost layer in a manner substantially similar to that in Example 1 except that the (B) specific conductive particles are not added.

COMPARATIVE EXAMPLE 2

A conductive roll C2 is obtained by forming a conductive outermost layer in a manner substantially similar to that in Example 1 except that an addition amount of the (B) specific conductive particles is changed from 30 parts by weight to 100 parts by weight and conductive filler 2 (trade name: NICABEADS PC1020, manufactured by Nippon Carbon Co., Ltd., volume average particle diameter: 13 μm, average degree of circularity: 0.93) is used as the (B) specific conductive particles.

COMPARATIVE EXAMPLE 3

A conductive roll C3 is obtained by forming a conductive outermost layer in a manner substantially similar to that in Example 1 except that, in place of the (B) specific conductive particles, insulating particles (trade name: SBX-6, manufactured by Sekisui Chemical Co., Ltd., volume average particle diameter: 6 μm, average degree of circularity: 0.99) are added.

<Evaluation of Charging Member>

The charging rolls obtained in the respective Examples and Comparative examples are measured and evaluated with respect to the surface roughness, charging property, endurance and image quality.

—Surface Roughness—

The ten point-average surface roughness Rz of a charging roll surface is measured based on JIS B0601 (1994). Specifically, under an environment of 23° C. and 55% RH, a contact surface roughness meter (trade name: SURFCOM 570A, manufactured by TOKYO SEIMITU CO., LTD.) is used to measure. When the surface roughness is measured, a measurement distance is set at 2.5 mm, a contact stylus having a diamond tip (5 μmR, 90° cone) is used, and a measurement is repeated three times with a position varying. An average value thereof is referred to as a ten point-average surface roughness Rz.

—Charging Property—

The above-obtained charging roll is incorporated in DOCUCENTRE III C3300 (trade name, manufactured by Fuji Xerox Co., Ltd.) in place of a charging roll incorporated in the apparatus and used to print a 50% halftone image on A4 forms ($C^2$ PAPER: trade name, manufactured by Fuji Xerox Co., Ltd.) under an environment of 10° C. and 15% RH. When an AC current value applied to the charging apparatus is varied (increased) stepwise from 1.0 mA, an AC current value where image defects disappear is read.

A: An image defect disappears when an AC current value is 1.35 mA or less.

B: An image defect disappears when an AC current value is more than 1.35 mA but 1.4 mA or less.

C: An image defect disappears when an AC current value is more than 1.4 mA but 1.5 mA or less.

D: An image defect disappears when an AC current value exceeds 1.5 mA.

—Evaluation of Endurance and Image Quality—

The charging roll is incorporated in a drum cartridge of DOCUCENTRE COLOR 400CP (trade name, manufactured by Fuji Xerox Co., Ltd.), a print test of 50000 A4 forms (50,000 sheets under an environment of 10° C. and 15% RH) is conducted, followed by printing a 50% halftone image by use of DOCUCENTRE COLOR 400CP, further followed by visually observing the resulting image and evaluating based on criteria shown below.

A: Image irregularity is not at all found.

B: Very slight image irregularity is found with no problem.

C: Slight image irregularity is found with no problem.

D: Image irregularity is observed.

E: Image irregularity is observed in almost all area.

Results of the above evaluation are shown in the following Table 2 and Table 3. Each mount shown in columns of Resin, Conductive agent, Specific conductive particles and Catalyst in Table 2 and Table 3 below is based on "parts by weight".

TABLE 2

| | | Example 1 | Example 2 | Example 3 | Example 4 | Example 5 | Example 6 | Example 7 | Example 8 | Example 9 |
|---|---|---|---|---|---|---|---|---|---|---|
| Photoreceptor | | 1 | 1 | 1 | 1 | 1 | 1 | 2 | 1 | 1 |
| Conductive elastic roll | | A | A | A | A | A | A | A | B | A |
| Cleaning member | | a | a | a | a | a | a | a | a | b |
| Shape of cleaning member | | Roll | Roll | Roll | Roll | Roll | Roll | Roll | Roll | Roll |
| Resin | N-methoxy-methylated nylon | 100 | 100 | 100 | 100 | 100 | 100 | 100 | 100 | 100 |
| Conductive agent | Carbon black | 17 | 17 | 17 | 17 | 17 | 17 | 17 | 17 | 17 |
| Specific conductive particles | Conductive filler 1 | 30 | — | — | — | — | — | 30 | 30 | 30 |
| | Conductive filler 2 | — | 30 | — | — | — | — | — | — | — |
| | Conductive filler 3 | — | — | 30 | — | — | — | — | — | — |
| | Conductive filler 4 | — | — | — | 30 | — | — | — | — | — |
| | Conductive filler 5 | — | — | — | — | 30 | — | — | — | — |
| | Conductive filler 6 | — | — | — | — | — | 30 | — | — | — |
| Catalyst | NACURE 4167 | 4.4 | 4.4 | 4.4 | 4.4 | 4.4 | 4.4 | 4.4 | 4.4 | 4.4 |
| Surface roughness (μm) | | 9.6 | 12.6 | 9.2 | 13.1 | 9.1 | 9.7 | 10.1 | 8.8 | 9.6 |
| Charging property | | A | A | A | A | B | B | A | A | A |
| Endurance and image quality | | A | A | A | A | A | A | A | A | A |

TABLE 3

| | Example 10 | Example 11 | Example 12 | Example 13 | Example 14 | Comparative Example 1 | Comparative Example 2 | Comparative Example 3 |
|---|---|---|---|---|---|---|---|---|
| Photoreceptor | 1 | 1 | 1 | 1 | 2 | 1 | 1 | 1 |
| Conductive elastic roll | A | A | A | A | A | A | A | A |
| Cleaning member | a | a | a | a | a | a | a | a |
| Shape of cleaning member | Pad | Roll | Roll | Roll | Roll | Roll | Roll | Roll |

TABLE 3-continued

| | | Example 10 | Example 11 | Example 12 | Example 13 | Example 14 | Comparative Example 1 | Comparative Example 2 | Comparative Example 3 |
|---|---|---|---|---|---|---|---|---|---|
| Resin | N-methoxy-methylated nylon | 100 | 100 | 100 | 90 | 90 | 100 | 100 | 100 |
| | Polyvinyl acetal resin | — | — | — | 10 | — | — | — | — |
| | Melamine resin | — | — | — | — | 10 | — | — | — |
| Conductive agent | Carbon black | 17 | 17 | 17 | 17 | 17 | 17 | 17 | 17 |
| Specific conductive particles | Conductive filler 1 | 30 | 5 | — | 30 | 30 | — | — | — |
| | Conductive filler 2 | — | — | 50 | — | — | — | 100 | — |
| | Conductive filler 3 | — | — | — | — | — | — | — | — |
| | Conductive filler 4 | — | — | — | — | — | — | — | — |
| | Conductive filler 5 | — | — | — | — | — | — | — | — |
| | Conductive filler 6 | — | — | — | — | — | — | — | — |
| Comparative particles | Insulating filler | — | — | — | — | — | — | — | 30 |
| Catalyst | NACURE 4167 | 4.4 | 4.4 | 4.4 | 4.4 | 4.4 | 4.4 | 4.4 | 4.4 |
| Surface roughness (μm) | | 9.6 | 2.3 | 19.8 | 9.6 | 9.6 | 1.8 | 21.6 | 9.6 |
| Charging property | | A | A | A | A | A | D | A | D |
| Endurance and image quality | | A | A | A | A | A | C | C | C |

From the foregoing results, it is found that in Examples that use a charging member of the exemplary embodiment of the invention, in comparison with Comparative Examples, a body to be charged is charged with less fluctuation, excellent image quality is maintained even after printing on 50000 forms is conducted and charging with less fluctuation is maintained over a long period of time.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A charging member comprising at least:

a base material; and a conductive outermost layer that is disposed on the base material, comes into contact with a body to be charged, has a ten-point average surface roughness Rz of about 2 μm to about 20 μm, and comprises (A) a resin and (B) specific conductive particles for forming the surface roughness, the charging member coming into contact with the body to be charged, in a state where a voltage is applied, to charge the body to be charged, wherein the (A) resin comprises a polyamide resin, a gel fraction of the conductive outermost layer is 50% or more, a volume average particle diameter of the (B) specific conductive particles is in a range of from about 2 μm to about 20 μm, and the conductive outermost layer further comprises conductive particles (C) having an average particle diameter of from 1 nm to 200 nm.

2. The charging member of claim 1, wherein an average degree of circularity of the (B) specific conductive particles is about 0.8 to about 1.0.

3. The charging member of claim 1, wherein a specific gravity of the (B) specific conductive particles is about 2 $g/cm^3$ or less.

4. The charging member of claim 1, wherein the (B) specific conductive particles are particles selected from the group consisting of amorphous carbon fine particles, carbon fine particles and graphite fine particles.

5. The charging member of claim 1, wherein the polyamide resin is methoxymethylated polyamide.

6. A process cartridge comprising at least:

an image holding member; and the charging member of claim 1, which comes into contact with the image holding member.

7. The process cartridge of claim 6, wherein an average degree of circularity of the (B) specific conductive particles is about 0.8 to about 1.0.

8. The process cartridge of claim 6, wherein a specific gravity of the (B) specific conductive particles is about 2 $g/cm^3$ or less.

9. An image forming apparatus comprising:

an image holding member;

the charging member of claim 1 disposed so as to come into contact with the image holding member to charge the image holding member;

an exposing unit that forms an electrostatic latent image on the charged image holding member;

a developing unit that develops the electrostatic latent image formed on the image holding member with a toner to form a toner image; and a transferring unit that transfers the toner image onto a transfer receiving body.

10. The image forming apparatus of claim 9, wherein an average degree of circularity of the (B) specific conductive particles is about 0.8 to about 1.0.

11. The image forming apparatus of claim 9, wherein a specific gravity of the (B) specific conductive particles is about 2 $g/cm^3$ or less.

12. A charging roll comprising at least:

a base material; and a conductive outermost layer that is disposed on the base material, comes into contact with a body to be charged, has a ten-point average surface roughness Rz of about 2 μm to about 20 μm, and comprises (A) a resin formed by crosslinking N-alkoxymethylated polyamide using a catalyst and (B) specific conductive particles for forming the surface roughness, the charging member coming into contact with the body to be charged, in a state where a voltage is applied, to charge the body to be charged, wherein a gel fraction of the conductive outermost layer is 50% or more, a volume average particle diameter of the (B) specific conductive particles is in a range of from about 2 μm to about 20 μm, and the conductive outermost layer further comprises conductive particles (C) having an average particle diameter of from 1 nm to 200 nm.

* * * * *